US006578746B1

(12) United States Patent
Greves

(10) Patent No.: US 6,578,746 B1
(45) Date of Patent: Jun. 17, 2003

(54) METHOD AND APPARATUS FOR PLACING A HOLDING APPARATUS ATOP A PERSON'S SHOE AND INSTALLING A GOLF BALL MARKER THERETO

(75) Inventor: Kenneth J. Greves, Lawrenceburg, IN (US)

(73) Assignee: Ceza, LLC, Lawrenceburg, IN (US)

( * ) Notice: Subject to any disclaimer, the term of this patent is extended or adjusted under 35 U.S.C. 154(b) by 76 days.

(21) Appl. No.: 09/698,326

(22) Filed: Oct. 27, 2000

(51) Int. Cl.[7] ..... A43B 5/00

(52) U.S. Cl. ..... 224/918; 36/132; 36/127; 473/406

(58) Field of Search ..... 36/132, 136, 127; 473/406; 224/918, 269, 666, 249; 206/470

(56) References Cited

U.S. PATENT DOCUMENTS

| | | | | | |
|---|---|---|---|---|---|
| 2,560,414 | A | * | 7/1951 | Cheney | 206/315.1 |
| 2,662,677 | A | | 12/1953 | Perry | |
| 3,233,802 | A | | 2/1966 | Ludwick | |
| 3,556,364 | A | | 1/1971 | Maretka | |
| 3,674,189 | A | | 7/1972 | Walbeck | |
| 3,744,542 | A | * | 7/1973 | Stephens et al. | 206/350 |
| 3,819,095 | A | | 6/1974 | Snyder | |
| 3,923,215 | A | | 12/1975 | Suzuki | |
| 4,129,237 | A | | 12/1978 | Grinder | |
| 4,130,950 | A | | 12/1978 | Bazzle et al. | |
| 4,475,676 | A | * | 10/1984 | Smith | 224/247 |
| 4,530,500 | A | | 7/1985 | Kaymen | |
| 4,627,621 | A | | 12/1986 | Tate | |
| 5,305,999 | A | | 4/1994 | Tate | |
| 5,433,436 | A | | 7/1995 | Hoyt et al. | |
| 5,596,821 | A | * | 1/1997 | Solo | 36/136 |
| 5,671,517 | A | * | 9/1997 | Gourley | 24/712.1 |
| 5,785,222 | A | * | 7/1998 | Basso et al. | 224/555 |
| 5,853,336 | A | * | 12/1998 | Hufgard | 473/282 |
| 6,102,263 | A | * | 8/2000 | Rosato et al. | 224/196 |

OTHER PUBLICATIONS

Product packaging: "Mark My Ball Installation Instructions," Goodwin Golf Group, Wayland, Massachusetts 01778 (2 pages).

* cited by examiner

*Primary Examiner*—Ted Kavanaugh
(74) *Attorney, Agent, or Firm*—Frederick H. Gribbell

(57) ABSTRACT

A golf ball marker holder is provided that can be placed upon the top surface of a golfer's shoe and attached to the shoe by sliding the shoe lace of the golfer's shoe up a slot, past a retaining structure, and into a receiving area, after which the shoe lace is tightened and the golf ball marker holder is retained in place. The holder is of a unitary structure having two major portions, in which these two portions are pivotally attached to one another to form an upper and lower portion that forms a slot therebetween. This slot is used to receive the shoe lace of a golfer's shoe, and the holder is maneuvered to slide the shoe lace through the slot and into a receiving area. Once the shoe lace reaches that receiving area, the shoe lace will be retained by a corner structure within the slot, which will not allow the shoe lace to easily slide back out of the slot. The holder includes a receptacle/orifice that is able to receive the protruding post of a golf ball marker of more than one size and shape. Once the golf ball marker has been placed into this receiving receptacle/opening, then the golfer will have a readily available ball marker which can be easily found and used when the golfer attempts to mark a ball on a putting green, for example.

19 Claims, 6 Drawing Sheets

METHOD AND APPARATUS FOR PLACING A HOLDING APPARATUS ATOP A PERSON'S SHOE AND INSTALLING A GOLF BALL MARKER THERETO

TECHNICAL FIELD

The present invention relates generally to golfing equipment and is particularly directed to a golf ball marker holder of the type which mounts on top of a person's shoe. The invention is specifically disclosed as holding apparatus that mounts to a person's shoe by sliding the shoe lace through a slot in the holding apparatus, and into a receiving area that has a contoured area that retains the shoe lace therein; a receptacle is provided on a top surface of the holding apparatus to receive a ball marker.

BACKGROUND OF THE INVENTION

There are a number of patents that disclose holders or carriers to contain ball markers, and several of these devices are to be used with a golfer's shoe. In some cases, a clip is used to fasten the holder/carrier to the side of a shoe. On the other hand, some of these devices have holes through which shoelaces are to be inserted, thereby holding the holder/carrier in place onto the golfer's shoe. Three examples of this type of design are patents by Suzuki, Walbeck, Perry, and Maretka, which are discussed below in more detail.

In many of these holder/carriers that contain ball markers, the marker itself is to be made of some type of metallic material that can be magnetized by a permanent magnet, and thereby held in place against the permanent magnet that is located in the holder/carrier. In most of these situations, the ball marker is simply a flat disc that is circular in shape. However, ball markers are also disclosed in patents that have a stud protruding from the center of the disc at a perpendicular angle. In some of these patents, the stud is to be engaged in a "snap relationship" to a recess or orifice in the holder/carrier. Examples of this arrangement are the Maretka and Grinder patents, which are discussed below in greater detail.

U.S. Pat. No. 3,923,215 (by Suzuki) discloses a golf ball position marker assembly which is mainly circular in shape. The "assembly" includes a golf ball marker that is in the form of a circular disc having a projection that will stick into the ground on a green, and includes a holder that has a circular recess. This recess also includes a permanent magnet to hold the marker disc in place, which also comprises a magnetizable material. The holding assembly includes a "hole" through which a shoelace can be placed. This hole in the first embodiment is generally rectangular in shape, and a groove is placed in one of the walls of this rectangular-shaped structure so that the shoelace or shoe "thread" can be passed through the groove and into the hole. This groove is not to be very large, so that the holding assembly will not easily fall off the shoelace once it has been attached thereto. This Suzuki holder assembly uses a ball marker that comprises some type of magnetizable material, which may retain a small magnetic field that potentially could affect a golf ball having an iron core. This could be a disadvantage with respect to the trajectory of a golf ball being putted on the green.

U.S. Pat. No. 3,674,189 (by Walbeck) discloses a golf accessories holder that can be worn on clothing or shoes, and can hold golf tees, a ball marker, and a green repair tool in various pockets. In one embodiment, a detachable and re-attachable strap is used to hold the accessories holder to a belt, or more precisely to strap it around the belt. In a second embodiment, a pair of holes in the accessories holder are provided through which a shoestring of the golfer's shoe is inserted, thereby holding the accessories holder in place. A center pocket that is V-shaped is used to hold a ball marker. In the illustrated embodiment of FIG. 1, the ball marker is depicted as comprising a small plastic or metal disc having a central stem portion that is pushed into the ground on the green surface. The accessories holder is more or less permanently attached to the shoestrings of the golfer's shoe, since the shoestrings must be run through holes in the accessories holder.

U.S. Pat. No. 2,662,677 (by Perry) discloses a golf tee holder that is attached to the laces of a golfer's shoe. This tee holder has three pockets, each having the capacity to hold a single golf tee. It is designed to be placed along the side of the golfer's shoe, and is disclosed as having three small holes near its top portion that are spaced so as to correspond exactly with eyelets or grommets of the golfer's shoe. The golf tee holder disclosed in Perry is made of a flexible material so that it will lay along the side of the golfer's shoe. It is designed so as to not interfere with normal walking so that it need not be removed from the shoe when the golfer is changing shoes.

U.S. Pat. No. 3,556,364 (by Maretka) discloses a golf accessory that is to be fastened to the outside of a golfer's shoe. The accessory is placed along the side of the shoe in which there are two holes near the top portion of the accessory that match up to the eyelets of the shoe. The golfer's shoelaces are to be inserted through these holes, thereby permanently affixing the golf accessory along the side of the shoe. This golf accessory can hold a pair of tees, and also a ball marker. The ball marker is essentially to be plugged into a recess near the bottom portion of the golf accessory. The ball marker is a circular disc, which has a male stud that protrudes at a perpendicular angle from the center of the circular disc. This male stud fits into a "snap retainer socket" that has a recess.

U.S. Pat. No. 4,129,237 (by Grinder) discloses a "golfer's aid" that holds golf tees, a divot repair tool, and a ball marker. This golfer's aid includes a spring clip that attaches the holder to a shoe, belt, waistband, or pocket, or potentially even the golfer's bag. This combination holder looks like a pouch-like piece of material having two elongated vertical pockets on its sides which hold two tees, a center vertical portion to hold a divot tool, and a "snap fastener" in the very middle of the holder that is designed to receive a male stud portion that is constructed as part of the ball marker. In this case, the ball marker comprises a circular disc having a center stud protruding at a perpendicular angle from the center of the disc. The spring clip portion of the combination holder allows this ball marker to clip over a pocket, a belt, or the side of a shoe.

U.S. Pat. No. 4,130,950 (by Bazzle) discloses a golfer's shoe that contains a permanent magnet. This permanent magnet is illustrated as being located along the side of the shoe, below the eyelets that hold the shoestrings in place. A thin metal disc ball marker is placed on the permanent magnet.

U.S. Pat. No. 5,433,436 (by Hoyt) discloses a golf accessory that holds tees and a ball marker, and also acts as a divot repair tool. This accessory device is to be clipped onto the side of the shoe of the golfer. The main portion of the accessory's clip that slides over the upper edge of a shoe is arranged essentially the same as any type of money clip or belt clip. The portion of the golf accessory that holds a ball marker is located above the portion of the clip that slides over the side of the shoe. This top portion or "handle" of the golf accessory has an orifice that receives a protruding pin or stud of a ball marker. There is no magnetic material involved in this ball marker holder.

U.S. Pat. No. 3,233,802 (by Ludwick) discloses a combination golf ball position marker and carrier, which is formed in the shape of a belt clip and includes a permanent magnet to hold two small magnetic discs. The general structure of the carrier is U-shaped, although one arm of the "U" extends further than the other. Within the U-shape is a channel or slot that is designed to receive a portion of the belt, or to be slid over the edge of a pocket. There are two little buttons formed within the interior wall structure of one side of this U-clip, which are designed to apply a small amount of pressure against the belt, thereby preventing the carrier from sliding off of the belt. The extended arm of this "U"-shaped device contains a permanent bar magnet. There are also a pair of circular recesses that can receive small circular discs that are composed of magnetizable material, for example, a zinc iron alloy. These discs are to be used in the same manner as a dime for ball placement on the green. These discs are to be slid into the recesses, after which the discs will be held in place by the permanent magnet that is contained within the U-shaped clip.

U.S. Pat. No. 4,530,500 (by Kaymen) discloses a golf ball position marker and storage device that is generally in the form of a belt clip. Its visual appearance makes it look like a money clip, however, it is designed to slip over a belt or the waistband of slacks or a skirt. The outer arm of the clip contains a knob that projects outwardly at a 90 degree angle from the clip, and from a round magnet that is permanently attached to the clip and around the periphery of the knob. A circular golf ball marker is designed to slip over the knob and against the permanent magnet, and therefore the marker itself is made of a magnetizable material. The marker is to have a center opening that is approximately the size of the knob, although somewhat larger so as to easily slip over the knob. According to Kaymen, the marker should be relatively large, about one inch in diameter or the size of a quarter. Moreover, Kaymen discusses the projections that are found on many golf ball markers and claims that these projections will eventually be declared illegal since they must be pressed into the soil of a green to anchor the marker. This apparently has not yet occurred, even though this patent was written over fifteen years ago.

U.S. Pat. No. 5,305,999 (by Tate) discloses a "golf accessory" that can be used to hold papers, a ball marker, a cigarette, or can be used to clean the face of irons. With respect to holding a ball marker, the golf accessory is generally circular in shape at its upper portion, and at its lower portion has a pair of prongs that are to be used to stick the accessory into the ground. This is the mode that is used to hold a lighted cigarette while the player takes a shot. The upper portions of the accessory include a 180 degree bend at the very top of the device, although this bend cannot be viewed except from the side. From the front or back, the top portion appears to be circular. On one side of the circular outer surfaces is an emblem that could be used to designate a particular golf tournament. On the opposite side, the circular appearance includes a recess that can hold a circular ball marker. In the illustrated embodiments described in Tate, there is a permanent magnet that is located within the recess, so that the ball marker (made of a magnetically activated material) can be placed into the recess and retained by the magnet. There is a leaf spring that can be used to hold papers in place like a money clip, if desired. This leaf spring is on the inner surface of the U-shaped interior bent portion that makes up the top portion of the accessory. It would be possible to also clip the entire accessory to a belt, cap, shoe, or golf bag.

U.S. Pat. No. 3,819,095 (by Snyder) discloses a device that holds a golfer's "accouterments." These accouterments include a pair of ball markers, three tees, and a divot repair tool. These devices are generally attached to the front side of the accessory by some type of springs or other cords that hold the tees and the divot tool in place. The ball markers are the type that comprise a circular disc and have a spike or stud extending from the center of the disc at a perpendicular angle. In this Snyder patent, the spike of the ball marker is placed through a recess in a (more or less) rigid portion of the accessory to hold these ball markers in place. The overall accessory uses a spring clip to attach the accessory to a belt, waistband, or shoes of the golfer. There is no specific drawing showing exactly how this accessory holder would be used with a shoe, just the mere mention that sometimes female golfers attempt to attach tees and ball markers to their shoes.

U.S. Pat. No. 4,627,621 (by Tate) discloses a "golf accessory" that can be clipped onto a belt, cap, shoe, or golf bag. This accessory can be used as a divot tool, a money clip, a golf ball radius gauge, or a golf club face defect finder. The accessory has a "centerpiece" circular disk that is to used as an ornamental area to commemorate a golf course or a golf tournament. This patent discloses a similar structure to that of U.S. Pat. No. 5,305,999 (also by Tate), however, this Tate '621 patent does not discuss ball markers.

It would be desirable to provide a ball marker holder that can slip over a golfer's shoe lace and direct that shoe lace into a receiving area that, once entered, will retain the shoe lace therewithin. There would be even more advantage to such an arrangement whereby the shoe lace does not need to be directed through a hole or other encircled opening for the means for attaching the ball marker holder to the golfer's shoe.

SUMMARY OF THE INVENTION

Accordingly, it is an advantage of the present invention to provide a golf ball marker holder that includes a slot-type area to receive a shoe lace of a golfer's shoe, and after receiving the shoe lace, sliding that shoe lace into a receiving area that will be used to retain the shoe lace. It is another advantage of the present invention to provide a golf ball marker holder in which a shoe lace receiving area can be easily accessed, and after the shoe lace has been placed into that receiving area, the shoe lace will be retained by the shape of the receiving area, including the shape of a slot through which the shoe lace traveled to reach that receiving area. It is another advantage of the present invention to provide a golf ball marker holder of a unitary construction, in which the holder is made up of two portions that are pivotally attached to one another, and when the two portions are mated will form the unitary structure with a slot to receive the shoe lace of a golfer's shoe.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a golf ball marker holder is provided that can be placed upon the top surface of a golfer's shoe and by which an attaching methodology is one where the shoe lace of the golfer's shoe is slid up a slot, past a retaining structure, and into a receiving area, after which the shoe lace is tightened and the golf ball marker holder is retained in place. In the embodiment illustrated herein, the golf ball marker holder is of a unitary structure having two major portions, in which these two portions are pivotally attached to one another to form an upper and lower portion that forms a slot therebetween. This slot is used to receive the shoe lace of a golfer's shoe, and the golf ball marker holder is maneuvered to slide the shoe lace through the slot and into a receiving area. Once the shoe lace reaches that receiving area, the shoe lace will be retained by a corner structure within the slot, which will not allow the shoe lace to easily slide back out of the slot. Thus, the golf ball marker holder is retained by the shoe lace on top of the golfer's shoe.

The golf ball marker holder includes a receptacle/orifice that is able to receive the protruding post of a golf ball marker of more than one size and shape. Once the golf ball marker has been placed into this receiving receptacle/opening, then the golfer will have a readily available ball marker which can be easily found and used when the golfer attempts to mark a ball on a putting green, for example. Most golfers would prefer to have two such golf ball marker holders, one per shoe. This allows the golfer to mark two balls simultaneously.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
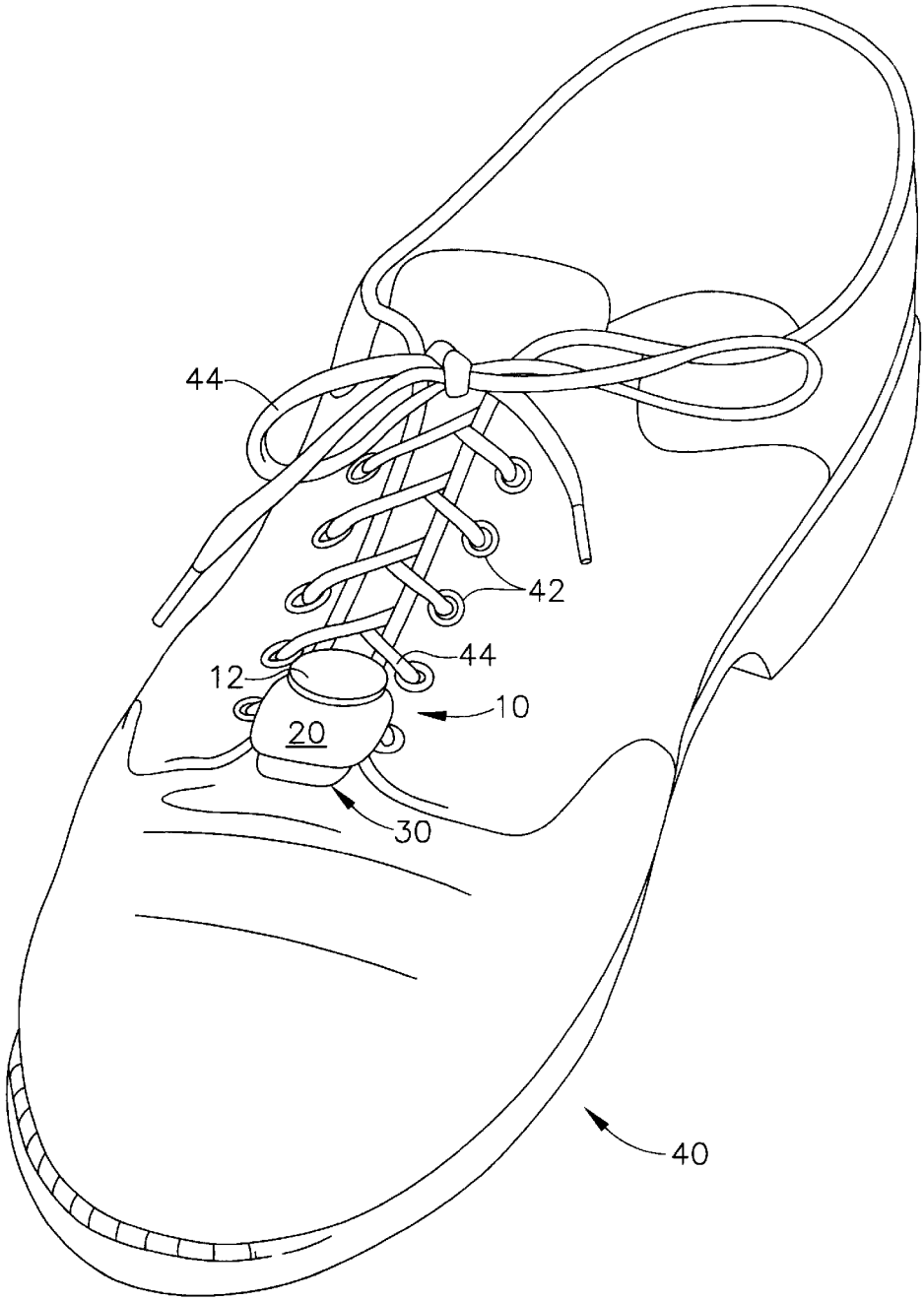
FIG. 1 is a perspective view, from the front and above, of a golf ball marker holder mounted on a shoe, and retaining a golf ball marker, as constructed according to the principles of the present invention.

Referring now to the drawings, FIG. 1 shows a golf ball marker holder, generally designated by the reference numeral 10, which is illustrated as being mounted on a person's shoe, generally designated by the reference numeral 40. As will be seen from the other views, golf ball marker holder 10 is mounted directly to the shoe laces 44, and is not directly connected to any of the shoe eyelets 42 (i.e., the holder 10 is not dependent upon the shoe eyelets 42 as a method for attachment to the shoe laces 44).

Golf ball marker holder 10 is made of two major portions, an "upper" portion 20 and a "lower" portion 30, in which the upper portion 20 contains a receptacle or orifice, generally designated by the reference numeral 24, to receive the post or stud of a golf ball marker. It will be understood that the receptacle/orifice 12 could be of a different configuration, and could be any type of recess that is capable of receiving the stud of a golf ball marker. In fact, it desired, the receptacle/orifice 12 could be replaced with a smooth surface having a magnetic property, in which a golf ball marker made of a magnetic material (such as soft steel) could be mated to the upper portion 20 in that area. This region at 12 on the drawings will also sometimes be referred to below as an "acceptance region," since its primary purpose is to accept a golf ball marker.

Figure 2:
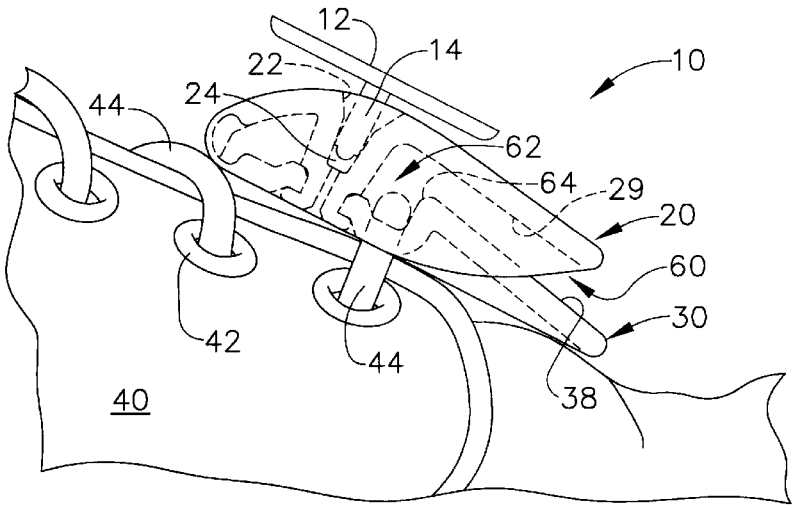
FIG. 2 is side, elevational view of the golf ball marker holder of FIG. 1, depicted as being mounted on a shoe.

FIG. 2 shows a side elevational view of the golf ball marker holder 10 in relationship to being mounted atop a golf shoe 40, in which the front shoe lace 44 has been passed through a slot, generally designated by the reference numeral 60, to retain the holder 10 in place atop the shoe 40. As can be seen in FIG. 2, the holder 10 is positioned so that the shoe lace 44 (which would be loosened during installation) is received by the slot 60. To install the holder 10, the shoe lace is slid up the slot 60, past a corner 64 in the slot until the shoe lace 44 is received in a lower, receiving area at 62. This corner 64 represents a substantial change in contour of the upper surface of lower portion 30, and further represents substantially the "end" of the upper surface that comprises an elongated ramped surface 38.

Once the shoe lace has been tightened, it will remain in place in the receiving area 62, and will not be able to slide past the corner 64 and further down the slot 60, thereby retaining the holder 10 in place. The slot 60 is bounded by the elongated inner surface 38 of the lower portion 30 and an elongated inner surface 29 of the upper portion 20. These surfaces are most effective if they are relatively smooth, so that the shoe lace can easily transit through slot 60, until reaching the receiving area 62. It will be understood that, without departing from the principles of the present invention, the corner 64 and receiving area 62 could be formed in the upper portion 20 if desired, which would change the configuration of the slot 60 and would change the orientation of the shoe lace 44 within the slot 60.

Also viewed on FIG. 2 is the golf ball marker 12, which has a protruding post or stud 14 that is placed into a receiving receptacle or orifice 24, which in this illustrated embodiment has a chamfer near its upper surface, as illustrated at 22. As noted above, the receptacle/orifice 24 could be of any desired shape to receive the stud of a golf ball marker, or an entirely different methodology for attaching the ball marker to the holder 10 could be used, without departing from the principles of the present invention.

Figure 3:
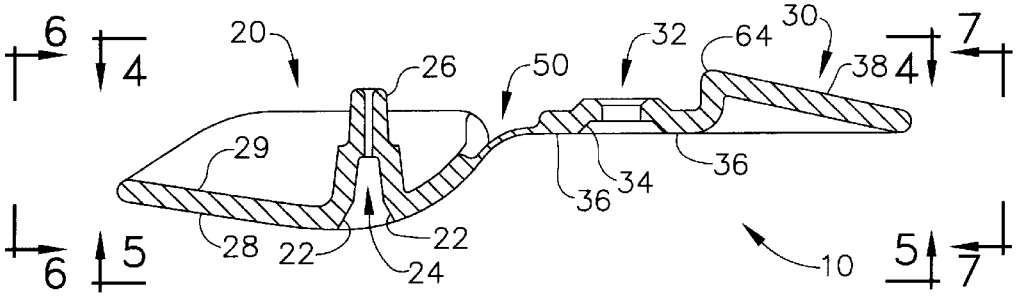
FIG. 3 is a side, elevational view in cross-section of an "unfolded" blank golf ball marker holder, as constructed according to the principles of the present invention.

FIG. 3 is a side elevational view of the golf ball marker holder 10 as it appears as a blank after being molded by a plastic injection molding machine. This is probably the most economical way of forming the golf ball marker holder 10, although materials other than plastic could be used, and manufacturing procedures other than plastic injection molding could be used to construct the holder 10. Many of the details of the holder 10 can be seen in FIG. 3, including the two major portions 20 and 30, as described above.

The upper portion 20 is viewed on the left-hand side in FIG. 3, and includes a curved upper surface at 28 (which is viewed as a "lower" surface in FIG. 3), as well as the receptacle or orifice which is designated by the reference numeral 24. The chamfered sides at the opening portion of the receptacle/orifice are illustrated at 22.

The receptacle/orifice 24 continues to a point, at which the opening narrows considerably and becomes a "rivet post"-type structure, generally designated by the reference numeral 26. This rivet post 26 will be placed through a different opening or orifice to mate the two portions 20 and 30 into the structure illustrated on FIG. 2.

The "lower portion" 30 is illustrated on the right-hand side of the structure of FIG. 3. This lower portion 30 includes an elongated ramped surface at 38 which culminates in the corner 64 that was described above. On the opposite surface of the lower portion 30 is a relatively flat surface at 36, through which an opening/orifice is placed at 32. This opening/orifice 32 includes a bottom area that is enlarged in diameter and is also chamfered in the illustrated embodiment of FIG. 3, and this portion is designated by the reference numeral 34.

A living hinge at 50 is made of somewhat thinner plastic material in the illustrated embodiment of FIG. 3. Of course, other structures could be used to perform in an equivalent manner, although if a plastic injected part is going to be used, then the living hinge 50 is probably the most economical construction methodology for performing the necessary function of pivoting the upper portion 20 with respect to the lower portion 30. The overall appearance of the holder 10, once these two portions 20 and 30 have been pivoted, is viewable on FIG. 8.

Figure 4:
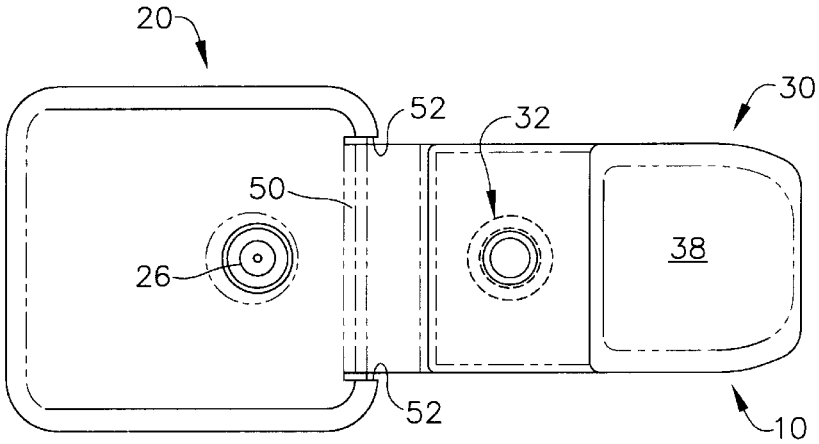
FIG. 4 is a top, plan view of the "unfolded" blank golf ball marker holder of FIG. 3.

While FIG. 3 is a side, elevational view of the blank holder 10, FIG. 4 is a top plan view of this same blank 10. In this view, it can be seen that two "cut-out" areas are provided at 52 as part of the living hinge structure, which are designed to relieve some of the stress on the living hinge 50 as it is pivoted to fold the top and bottom portions 20 and 30 together (as will be seen in later views).

Figure 5:
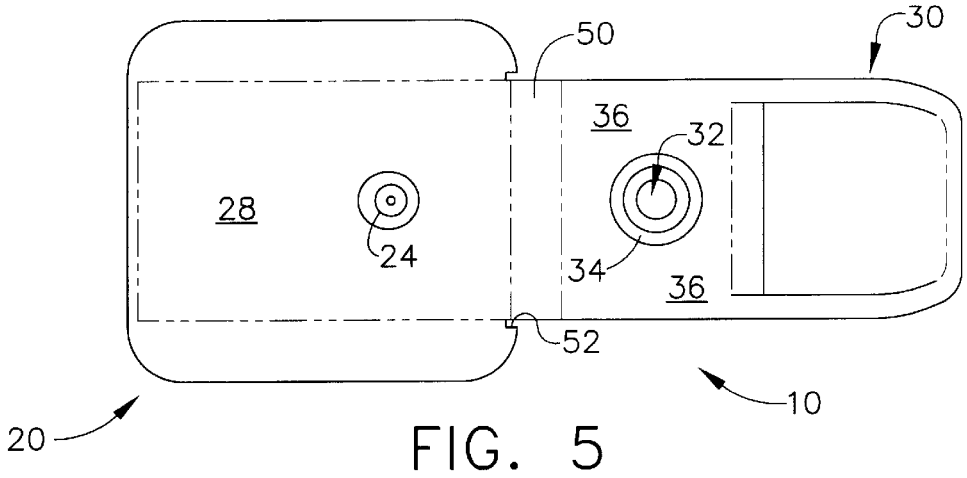
FIG. 5 is bottom view of the "unfolded" blank golf ball marker holder of FIG. 3.
Figure 6:
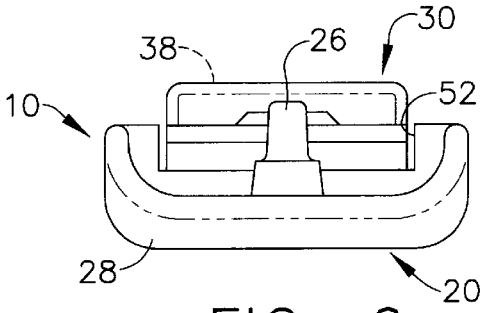
FIG. 6 is a front, elevational view of the "unfolded" blank golf ball marker holder of FIG. 3.
Figure 7:
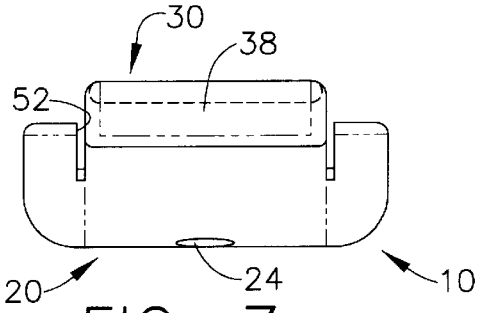
FIG. 7 is a rear elevational view of the "unfolded" blank golf ball marker holder of FIG. 3.

FIG. 5 is a similar view of the blank holder 10, however this view is from the bottom of the blank as seen in FIG. 3. Similarly, FIG. 6 is a "front view" of the unfolded blank holder 10, in which this front view is seen from the left-hand side in FIG. 3. FIG. 7 is a "rear view" of the same unfolded blank 10, in which the rear view is seen from the right-hand side of FIG. 3. The unfolded blank holder 10 will also be sometimes referred to below as an "unfolded holder apparatus."

Figure 8:
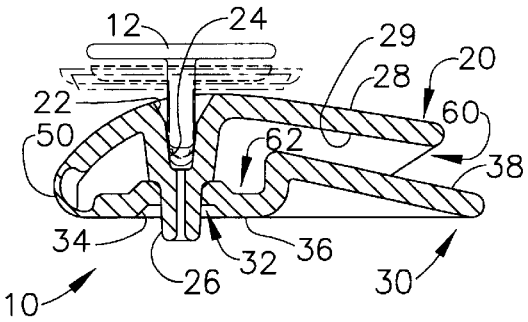
FIG. 8 is a side, elevational view in cross-section of the "folded" golf ball marker holder of FIG. 2, showing various types of ball markers mounted in place atop the holder.

FIG. 8 is a cross-sectional elevational view from the side of the holder 10 which shows the mating of the top (or "upper") portion 20 and the bottom (or "lower") portion 30, which are formed together by pivoting these two portions at the living hinge 50, and continuing this pivoting action until the rivet post 26 mates into and through the hole/orifice 32 until seated in place. In FIG. 8, it can be seen that the most protruding portion of the rivet post 26 protrudes all the way through and past the chamfered and widened area 34 of the opening/orifice 32. The most protruding portion of rivet post 26 is preferably later flattened so that there is no protrusion past the bottom surface 36 of the holder 10 when in its final form for sale to customers. This can be performed by more than one technique, but the end result will have the appearance as viewed in FIG. 13, in which the flattened portion of the rivet post tends to fill up some of the space in the widened area at 34 of the opening/orifice 32, as illustrated at the reference numeral 27 on FIG. 13.

Referring back to FIG. 8, now that the top and bottom portions 20 and 30, respectively, have been mated together, the slot 60 is formed between surfaces 29 and 38, thereby making the holder 10 essentially ready for use, except for the flattening of the rivet post 26. In FIG. 8, four different types of golf ball markers are illustrated as being constructed of somewhat different sizes and shapes, although their posts are all capable of being placed into the receptacle/orifice 24 for a "snug fit."

Figure 9:
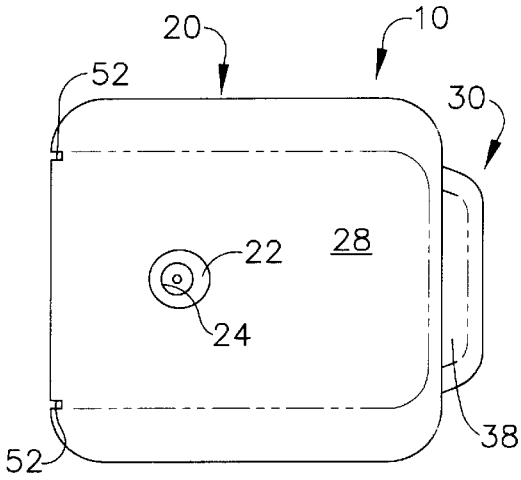
FIG. 9 is a top, plan view of the "folded" golf ball marker holder of FIG. 8, without any ball markers.

FIG. 9 is a top plan view of the folded holder 10, and in this view it can be seen that the lower portion 30 extends further to the right (on this drawing) and, therefore, can be seen in this view. The upper surface 38 of the lower portion 30 forms the "ramp" that is used to force the shoe lace up the ramped surface 38 through the slot 60, until the shoe lace is placed past the corner 64, as seen on FIG. 13, for example.

Figure 10:
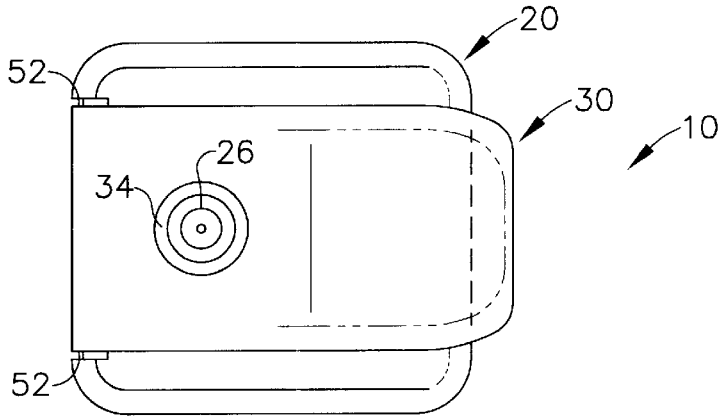
FIG. 10 is bottom view of the "folded" golf ball marker holder of FIG. 9.
Figure 11:
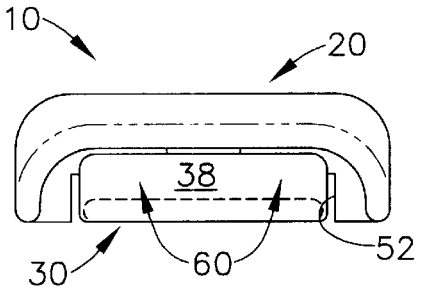
FIG. 11 is a front, elevational view of the "folded" golf ball marker holder of FIG. 9.
Figure 12:
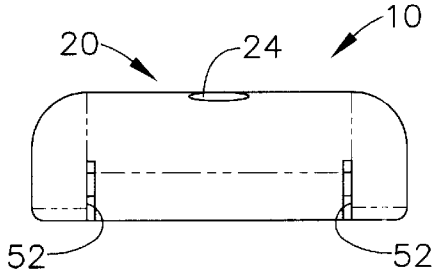
FIG. 12 is a rear, elevational view of the "folded" golf ball marker holder of FIG. 9.

FIG. 10 is a bottom view of the folded holder 10, while FIG. 11 is a front view of the folded holder 10, and FIG. 12 is a rear view of the folded holder 10. In FIG. 11, the open "slot" area at 60 can be seen, which is how the holder 10 would be presented to a shoe lace. As can be seen in FIG. 11, the shoe lace would not necessarily fit straight into the slot 60, but would be somewhat curved at its left-end and right-end portions to fit over the bottom portion 30 and into the slot 60.

The illustrated embodiment depicts the "front" shoe lace being utilized for placement into the slot 60 of the holder 10, which probably is the preferred mode of the using the present invention. However, it will be understood that a different portion of the shoe lace could be used by a human user, if desired, and in that situation the orientation and overall appearance of the holder 10 atop the shoe 40 would, of course, be different from that depicted on the drawings, such as on FIGS. 1 and 2, which would still be contemplated as an aspect of the present invention.

Figure 13:
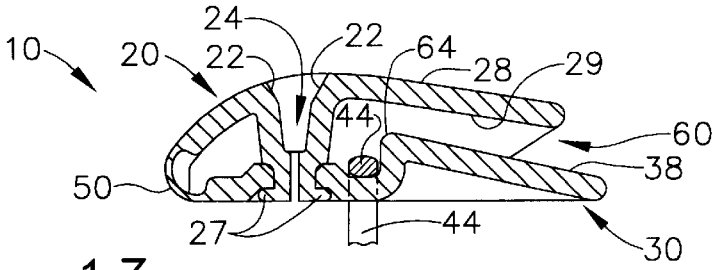
FIG. 13 is a side, elevational view in cross-section of the "folded" golf ball marker holder of FIG. 8, after the rivet post has been flattened, and showing a show lace in its correct position to retain the holder.

FIG. 13 is a side, elevational cross-section view of the folded holder 10, after the rivet post has been flattened to form the area illustrated at the reference numeral 27. This flattening can take place either by applying heat and pressure, or by some type of ultrasonic welding, or perhaps by another methodology. If using heat and pressure, the plastic material used to construct the holder 10 will have a minimum temperature at which the plastic will easily deform (i.e., its "plastic temperature"), and this temperature can be achieved in a localized area at the rivet post 26 as seen on FIG. 8. A flattened, heated structure to be used to first heat this protruding tip of the rivet post 26, and then press that protruding tip until it is flat along the same general surface line of the surface 36 of the bottom portion 30. Once that has been achieved, the temperature of the mechanical element applying the pressure can be decreased to the point that the plastic material is solidified, and once the mechanical implement is removed, the area at 27 will retain its shape.

If ultrasonic welding or an adhesive is used, then the exact shape of the opening/orifice 32 could be altered to be more useful in such an arrangement. For example, an ultrasonically welded permanent joint would not necessarily require that the "rivet post" 26 actually protrude through any type of aperture, opening, or orifice at the location illustrated on the drawings at 32 as an opening or orifice. Instead, the shape of the "rivet post" 26 would probably be more useful as an relatively thin angular chamfer that would seat into a recess on the lower portion 30 (at the location 32) that has a similar but opposite mating contour for a better ultrasonic weld, and which does not create a through-hole. If an adhesive is used, then the shape could be yet further different, however, the through-hole at 32 with a protruding rivet post 26 also could be used to good effect, especially if the adhesive "melts" the plastic mating parts together (such as a styrene plastic).

Also viewable on FIG. 13 is a shoe lace 44 as it would appear once it is placed into the receiving area 62 (see FIG. 14) and past the corner 64, after the shoe lace has previously been slid up through the slot 60.

Figure 14:
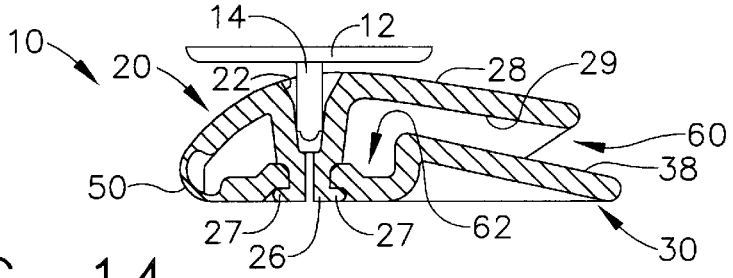
FIG. 14 is a side, elevational view in cross-section of the "folded" golf ball marker holder of FIG. 13, with a ball marker of a first type mounted in place.

FIGS. 14–17 are side, elevational views in cross-section of the holder 10 as it receives four different styles of golf ball markers. In FIG. 14, the golf ball marker is generally designated by the reference numeral 12, and having a stud 14 that fits into the receiving area, which is the receptacle/orifice 24 (see earlier figures).

Figure 15:
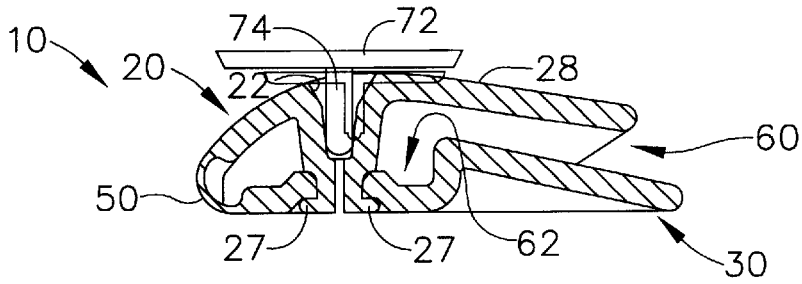
FIG. 15 is a side, elevational view in cross-section of the "folded" golf ball marker holder of FIG. 13, with a ball marker of a second type mounted in place.
Figure 16:
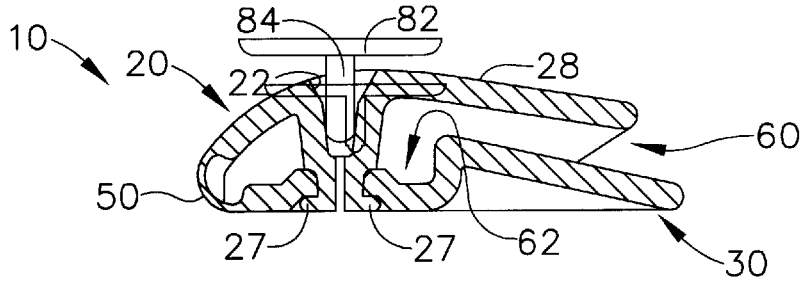
FIG. 16 is a side, elevational view in cross-section of the "folded" golf ball marker holder of FIG. 13, with a ball marker of a third type mounted in place.
Figure 17:
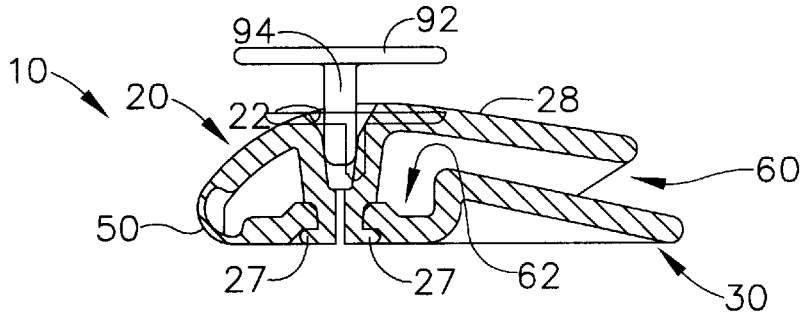
FIG. 17 is a side, elevational view in cross-section of the "folded" golf ball marker holder of FIG. 13, with a ball marker of a fourth type mounted in place.

FIG. 15 shows a different size and shape golf ball marker that is generally designated by the reference numeral 72, which has a stud 74 that fits into the receiving receptacle/orifice 24. FIG. 16 shows yet a different size and shape golf ball marker 82, which has a stud 84 that is received within the receptacle/orifice 24. Finally, FIG. 17 shows still a different golf ball marker at 92, having a stud 94 that is received into the receptacle/orifice 24. As seen in these figures, the receptacle/orifice 24 can be tapered at its inner diameter, so as to provide a snug fit for many different stud sizes.

Figure 18:
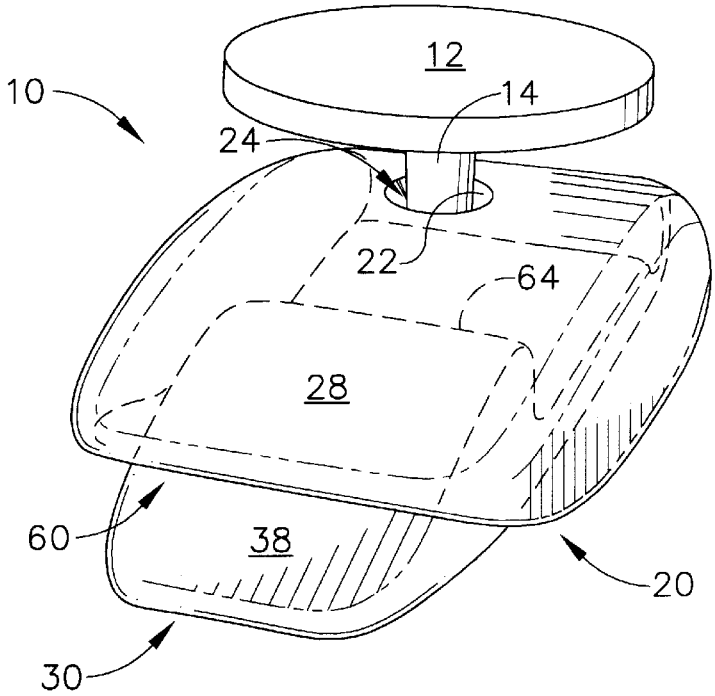
FIG. 18 is a perspective view, from the front and above, of the "folded" golf ball marker holder of FIG. 13, while retaining a golf ball marker.
Figure 19:
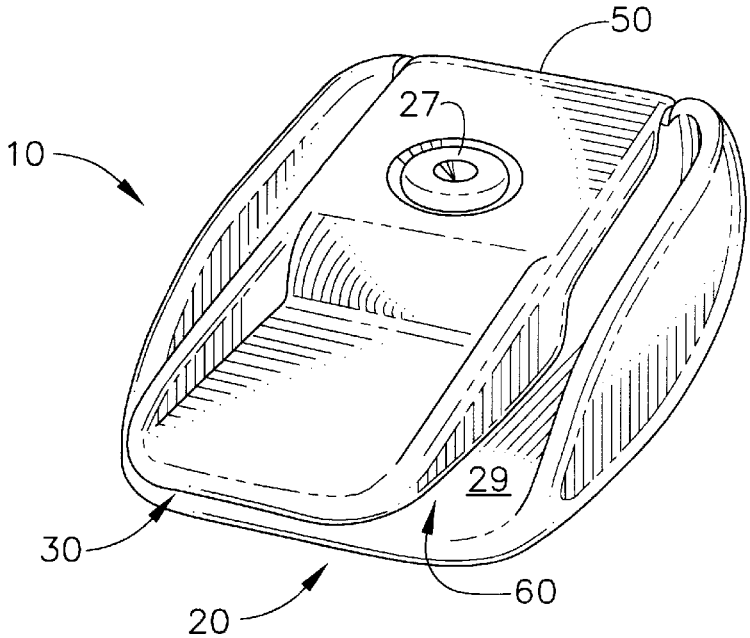
FIG. 19 is a perspective view, from the front and below, of the "folded" golf ball marker holder of FIG. 13, illustrating the flattened rivet post.

FIG. 18 is a perspective view of the golf ball marker holder 10 from the front and above, which also shows the golf ball marker 12 in place as its stud 14 protrudes into the receiving receptacle/orifice 24. FIG. 19 is a perspective view from the front and below of the golf ball marker holder 10, and in this view the flattened portion of the rivet post at 27 can be seen.

It will be understood that other sizes and shapes can be utilized to form the golf ball marker holder without departing from the principles of the present invention, in which a slot is formed to allow the shoe lace of a golfer's shoe to be slid up through the slot and into a receiving area in which the shoe lace is retained in that receiving area. Certainly the curved surfaces of the top and bottom portions as viewed in FIGS. 6 and 7 do not have to be shaped in exactly that same manner to perform these functions. For example, the upper portion 20 would not necessarily be required to totally enclose the shoe lace along the sides of the holder 10.

Another alternative construction could be to form a barb on the end of the rivet post 26, so that when the upper and lower portions 20 and 30, respectively, are folded together by pivoting along the living hinge 50, the barb at the far end of the rivet post 26 could snap through the opening/orifice 32 of the lower portion 30, and become immediately retained without the need for any type of ultrasonic welding or some type of heating and flattening operation. This barb could also be made to not protrude past the bottom surface 36, by shortening the rivet post, for example.

As described in the construction details above, the golf ball marker holder 10 of the present invention is designed to allow the shoe lace of a golfer's shoe to be easily placed through a slot in the holder, then slid through that slot until the shoe lace passes a certain construction feature, such as the corner 64, at which time the shoe lace will then enter a receiving area at which it will be easily retained by the overall inner construction configuration of the holder. Upon reaching that position, the shoe lace can then be tightened, at which time the golf ball marker holder of the present invention is retained quite well upon the top of the golfer's shoe. The golfer now has a place to easily find his or her golf ball marker, and this location is quite convenient since the golfer will typically be bending over to mark his or her ball on a putting green, which means that the golfer will be bending over and placing his or her hand near where his or her shoe is located. Naturally, it might be preferred for the golfer to use two golf ball marker holders, one per shoe. In this manner, the golfer could mark not only his or her own ball, but also a second person's ball simultaneously.

It will be understood that the receptacle/orifice 24 should be of a size and shape to readily receive the stud of most golf ball markers that are sold at this time, and this can be achieved with the proper dimensions and overall construction shape. In the illustrated embodiment of FIG. 13, it can be seen that the inner diameter of the receiving receptacle/orifice 24 is not necessarily a constant value, but can be tapered to a smaller inner diameter when travelling downward along this receiving area. This would allow a snug fit for more than one size stud for various types of golf ball markers.

As noted above, various types of materials could be used to construct the golf ball marker holder of the present invention, and various types of manufacturing processes also could be utilized. While plastic has certain advantages, such as being able to construct a living hinge and being able to be deformed at the rivet post with essentially minimal effort, other materials could be used if, for example, a more durable marker holder were desired. The holder could even be made of metal, in which the hinge could be a piano-type hinge or some other type of pivoting mechanism, and where the "rivet post" could instead be a threaded post to which a nut with a lock washer could be applied for a permanent attachment means.

The golf ball marker holder of the present invention could be constructed in various colors, and also could be made to receive indicia, such as advertising indicia, or to indicate the golfer's club membership, for example.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. An apparatus, comprising:

a first portion having a first elongated surface that ends at a substantial change in contour;

a second portion having a second elongated surface, said second elongated surface being spaced-apart from and facing toward said first elongated surface, said first and second elongated surfaces thereby forming a slot therebetween, said second portion exhibiting a curved area, wherein said curved area substantially forms at least two rounded corners, and wherein said curved area bounds at least a portion of said slot;

said slot being sufficiently wide to allow a shoe lace to transit therethrough, said slot including a receiving area proximal to said substantial change in contour of said first elongated surface, said receiving area being of a size to allow said shoe lace to be received therein; and said second portion having an outer surface that contains a receptacle structure, wherein said receptacle structure is capable of receiving and at least temporarily retaining a golf ball marker.

2. The apparatus as recited in claim 1, further comprising a shoe which includes said shoe lace, and after being placed into said receiving area, said shoe lace retains said apparatus atop said shoe with assistance of the substantial change in contour of said first elongated surface, and with assistance of said curved area of said second portion.

3. The apparatus as recited in claim 2, wherein said apparatus does not attach to any eyelet of said shoe.

4. The apparatus as recited in claim 1, wherein said first and second portions make up a unitary structure.

5. The apparatus as recited in claim 4, wherein said first and second portions are joined together by a pivotable member.

6. The apparatus as recited in claim 5, wherein said apparatus is constructed of a plastic material.

7. The apparatus as recited in claim 6, wherein said pivotable member comprises a living hinge, and said entire apparatus is manufactured by injection molding.

8. The apparatus as recited in claim 1, wherein said receptacle structure comprises a recess that is sized and shaped to receive a stud of said golf ball marker.

9. The apparatus as recited in claim 1, wherein said receptacle structure comprises a permanent magnetic material that will retain said golf ball marker when constructed of a magnetic material.

10. An unfolded holder apparatus, comprising:

a first portion having a first elongated surface that exhibits a substantial change in contour which creates an angular protrusion in said first elongated surface at a location between a first end and a second end of said first elongated surface, such that said protrusion causes said first elongated surface to be substantially non-planar at said protrusion, said first portion having a first mating structure;

a second portion having a second elongated surface, said second portion having a second mating structure;

a pivotable structure that is in mechanical communication with both said first and second portions;

wherein at least one of said fist portion and said second portion includes an acceptance region having an opening therein for use in receiving and at least temporarily retaining a golf ball marker which exhibits a protrusion; and wherein said first mating structure is sized and shaped to make a mechanical connection with said second mating structure when said unfolded holder apparatus is pivoted along said pivotable structure.

11. The unfolded holder apparatus as recited in claim 10, wherein said first portion and said second portion are pivoted toward one another along said pivotable structure, thereby bringing into contact said first mating structure and said second mating structure.

12. The folded holder apparatus as recited in claim 11, wherein the opening in said acceptance region comprises a recessed receptacle that provides a snug fit when placed into mechanical contact with a protrusion of a golf ball marker.

13. The folded holder apparatus as recited in claim 11, wherein said acceptance region is located upon an outer surface of said first portion.

14. The folded holder apparatus as recited in claim 11, wherein said acceptance region is located upon an outer surface of said second portion.

15. A folded holder apparatus, comprising:

a first portion having a first elongated surface that ends at a substantial change in contour, said first portion having a first mating structure;

a second portion having a second elongated surface, said second portion having a second mating structure;

a pivotable structure that is in mechanical communication with both said first and second portions;

wherein one of said first portion or said second portion includes an acceptance region having an opening therein for use in receiving and at least temporarily retaining a golf ball marker which exhibits a protrusion;

wherein said first mating structure is sized and shaped to make a mechanical connection with said second mating structure when said first portion and said second portion are pivoted toward one another along said pivotable structure to form said folded holder apparatus; and wherein said first mating structure comprises an orifice and said second mating structure comprises a protrusion that penetrates said orifice.

16. The folded holder apparatus as recited in claim 15, wherein the opening in said acceptance region comprises a recessed receptacle that provides a snug fit when placed into mechanical contact with a protrusion of a golf ball marker.

17. A folded holder apparatus, comprising:

a first portion having a first elongated surface that ends at a substantial change in contour, said first portion having a first mating structure;

a second portion having a second elongated surface, said second portion having a second mating structure;

a pivotable structure that is in mechanical communication with both said first and second portions;

wherein one of said first portion or said second portion includes an acceptance region for use in receiving and at least temporarily retaining a golf ball marker; and wherein said first mating structure is sized and shaped to make a mechanical connection with said second mating structure when said unfolded holder apparatus is pivoted along said pivotable structure, and said first mating structure comprises an orifice and said second mating structure comprises a protrusion that penetrates said orifice; and wherein said protrusion is flared and flattened at its distal end, thereby permanently affixing said first mating structure and said second mating structure into a predetermined orientation.

18. The folded holder apparatus as recited in claim 17, wherein said predetermined orientation comprises a spaced-apart relationship between a first elongated surface of said first portion and a second elongated surface of said second portion, thereby forming a slot.

19. The folded holder apparatus as recited in claim 18, wherein said slot is sufficiently wide to allow a shoe lace to transit therethrough, said slot including a receiving area proximal to said substantial change in contour of said first elongated surface, said receiving area being of a size to allow said shoe lace to be received therein.

* * * * *